US010758804B2

(12) United States Patent
Ugartechea et al.

(10) Patent No.: US 10,758,804 B2
(45) Date of Patent: Sep. 1, 2020

(54) SWIMMER PACING APPARATUS

(71) Applicants: Jason Ugartechea, Saginaw, MI (US); Ahmed Al-Abbas, Saginaw, MI (US); Solomon Musonda, Saginaw, MI (US); Kevin Jesse, Saginaw, MI (US)

(72) Inventors: Jason Ugartechea, Saginaw, MI (US); Ahmed Al-Abbas, Saginaw, MI (US); Solomon Musonda, Saginaw, MI (US); Kevin Jesse, Saginaw, MI (US)

(73) Assignee: Pace Light, LLC

( * ) Notice: Subject to any disclaimer, the term of this patent is extended or adjusted under 35 U.S.C. 154(b) by 0 days.

(21) Appl. No.: 15/845,622

(22) Filed: Dec. 18, 2017

(65) Prior Publication Data

US 2019/0184259 A1 Jun. 20, 2019

(51) Int. Cl.
*A63B 69/12* (2006.01)

(52) U.S. Cl.
CPC ..... *A63B 69/12* (2013.01); *A63B 2208/03* (2013.01); *A63B 2225/60* (2013.01); *A63B 2244/20* (2013.01)

(58) Field of Classification Search
CPC ..... A63B 69/12
USPC ..... 4/496; 482/55
See application file for complete search history.

(56) References Cited

U.S. PATENT DOCUMENTS

| | | | | |
|---|---|---|---|---|
| 5,325,340 | A * | 6/1994 | Ramsey | A63B 71/0686 368/10 |
| 6,086,379 | A * | 7/2000 | Pendergast | A63B 24/0003 434/254 |
| 9,067,121 | B1 * | 6/2015 | Beard | A63B 71/0686 |
| 2012/0009553 | A1 * | 1/2012 | Ben-Tal | A63B 24/0062 434/254 |
| 2012/0122064 | A1 * | 5/2012 | Ben-Tal | A63B 24/0062 434/254 |
| 2013/0040272 | A1 * | 2/2013 | Booher | G06F 19/3481 434/254 |
| 2014/0278229 | A1 * | 9/2014 | Hong | A63B 71/06 702/160 |
| 2016/0038815 | A1 * | 2/2016 | Snell | A63B 69/125 4/492 |
| 2017/0259114 | A1 * | 9/2017 | Yamada | A63B 24/0021 |

FOREIGN PATENT DOCUMENTS

| | | | | |
|---|---|---|---|---|
| WO | WO-8503881 | A1 * | 9/1985 | A63B 69/12 |

* cited by examiner

*Primary Examiner* — Lori L Baker
(74) *Attorney, Agent, or Firm* — Robert L. Farris

(57) ABSTRACT

The apparatus includes a light emitting pace rope positioned under water that shows where the swimmer should be to move at a selected pace. The LED rope includes a ribbon cable with ground, power and control wires. Equally space LEDs are attached to the ground and power wires along the cable. The cable and LEDs are received in a transparent plastic tube couplers are attached to the cable ends. The plastic tube is encased in transparent silicone. Ends of the LED rope are attached opposite pool end walls. A power supply is connected to a coupler. A micro-controller provided signals to the control wire which provides additional power to illuminate the LEDs one at a time at the selected pace. Additional LEDs are provided to continue the pace in the opposite direction.

10 Claims, 7 Drawing Sheets

SWIMMER PACING APPARATUS

CROSS REFERENCE TO RELATED APPLICATION

This application claims the benefit of the filing date of U.S. Provisional Application No. 62/435,620 titled SWIMMER PACING APPARATUS filed Dec. 16, 2016.

FIELD OF THE INVENTION

A pacing apparatus for training swimmer athletes includes a number of space apart light emitting diodes (LEDs) extending the length of the pool, below the water surface and in the center of a swimming lane and a programmable control system for illuminating LEDs in a timed order to indicate a selected swimmer pace.

BACKGROUND OF THE INVENTION

Swimmers like runners have selected training schedules that may be determined by a coach. Long distance swims for endurance are scheduled for one day at a slow pace. A moderate distance at a moderate pace may be scheduled another day. A number of high speed swimming laps with a short break between laps may be scheduled for another training period. A timed fixed distance swim after a warmup may be scheduled on a following day. Different paces are selected for the training events. As a training program progresses, the paces will increase. There will be times however when the pace is decreased by a coach to provide rest and recovery time between training days. There may also be days when a swimmer will perform two of the above training events.

Pacing lights have been placed on the floor of swimming pools to provide a pace during training. Pools used by competitive swimmers have an end with shallow water and an end with deep water. On the shallow water end, a light for pacing is generally a few vertical feet below a swimmer's eyes when the swimmer's head is in the water. The line of sight is vertical when the swimmer's eyes are vertically above a pacing light. Distortion of light through the water and swimming goggles is small when the swimmer's head and face is in the water. Most of the time a place light will be either to the front or to the rear of the swimmer's eyes. Swimmers are trained to keep their heads in line with their bodies when under the water or partially below the water surface. Their range of view without moving their heads is limited by the swimming goggles. However, the range is still a substantial range.

A group of LEDs for pacing a swimmer may work well in the shallow end of a pool where the depth of the lights is substantially constant and the swimmer's eyes are in the water. As the LEDs descent into the deep end of the pool, the horizontal space between adjacent uniformly spaced lights decreases. The length, of a portion of a light strip descending into a deep end of a pool, increases to reach to a pool end. Changes in spacing between LEDs is increased to maintain a horizontal space between LEDs that is the same the entire length of the pool. The increased space between LEDs maintains the horizontal spacing and the selected pace.

An alternative pacing system holds the LEDs near the same depth from the shallow end to the deep end. A tension force on a rope of LEDs is required to hold the LEDs up above the pool floor in the deeper portion of the pool.

SUMMARY OF INVENTION

The swimmer pacing apparatus includes an LED rope with a first end and second end. A translucent and flexible plastic tube extends from the first end to the second end of the LED rope. A ribbon cable includes a ground wire, a power wire and a control wire. The wires of the ribbon cable are parallel to each other and extend from the first end to the second end of the LED rope. A plurality of LEDs are attached to the ground wire and the power wire. The LEDs are spaced apart a selected distance from each other. The ribbon cable, with the attached LEDs, is mounted in the translucent and flexible plastic tube.

A first coupler is connected to the ribbon cable at the first end of the LED rope. A second coupler is connected to the ribbon cable at the second end of the LED rope.

A transparent silicone encases the LED rope in each rope section, from the first end to the second end of the LED rope.

The first end of the LED rope is anchored to a pool first end. The second end of the LED rope is anchored to a pool second end. The LED rope may be held in a horizontal position a selected distance below a normal water surface. An alternative construction holds the rope on the floor of the pool entire length.

A power supply, a micro controller and a user input and output device is attached to the ribbon cable through the first coupler.

The control wire is excited to illuminate the LEDs one LED at a time in an adjustable pace.

The LED rope is divided up into multiple sections for transporting to swimming pools and for manufacturing.

Tension members are mounted in the plastic tube to prevent rotation of the LED rope about a long axis of the rope.

BRIEF DESCRIPTION OF THE DRAWINGS

Presently preferred embodiments of the invention are disclosed in the following description and in the accompanying drawings, wherein.

DETAILED DESCRIPTION OF THE PREFERRED EMBODIMENTS

Figure 1:
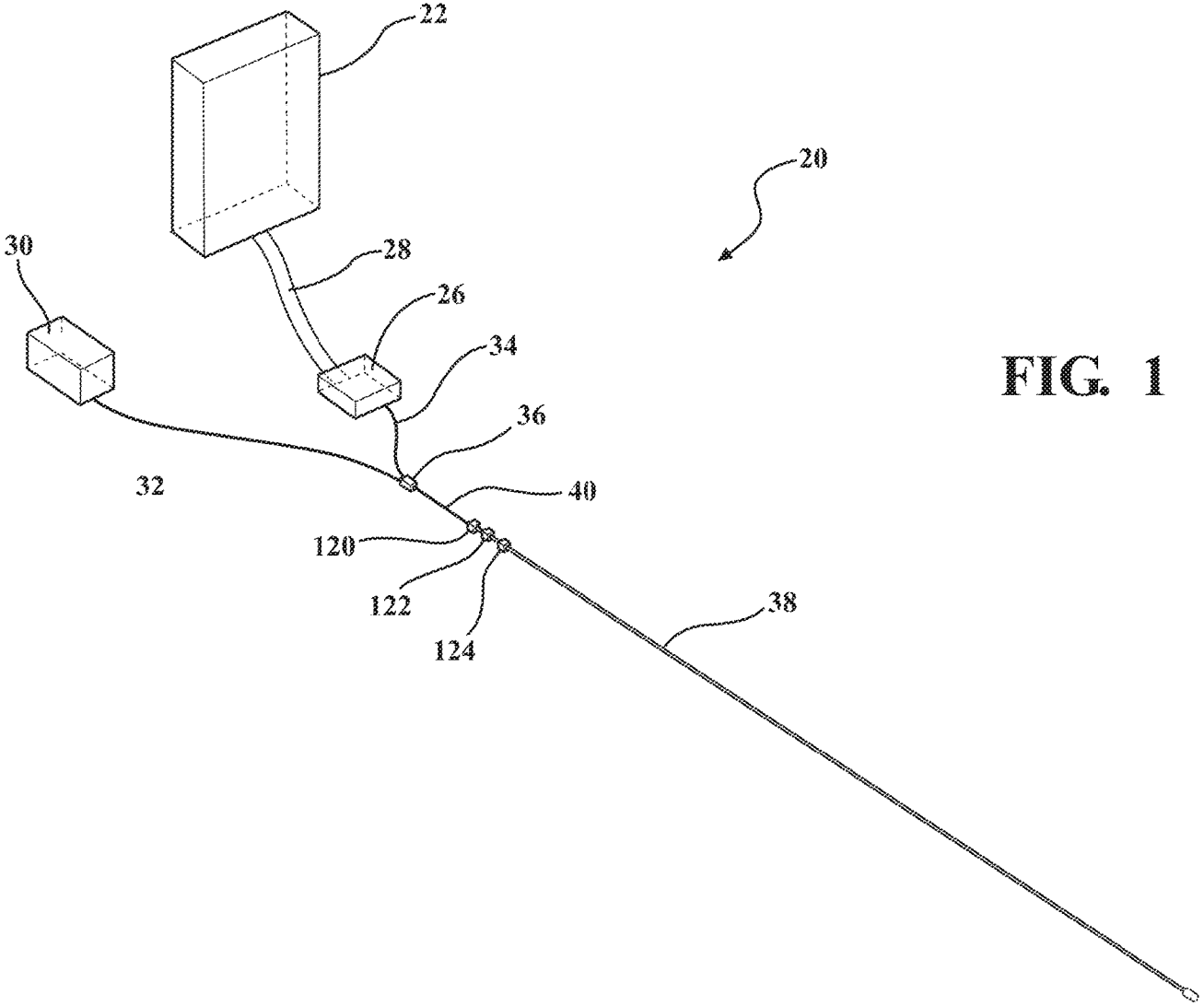
FIG. 1 is a perspective view of the pacing apparatus.

The swimmer pacing apparatus 20 includes a user input and output device 22. The input and output device 22 may be in an area adjacent to a pool 24 or in a room near the pool. A microcontroller 26 is positioned adjacent to the pool 24 and to a swimmer pool entry support platform 27. The support platform 27 is raised above the water. A second support platform 29 is provided above the deep end of the pool 24. The microcontroller 26 is connected to the input and output device 22 by a suitable communication cable 28. A power supply 30 is connected to the microcontroller 26 by leads 32, leads 34 and a fuse 36. The fuse 36 connects the microcontroller 26 and the power supply 30 to a LED rope 38 through a multi wire cable 40. The multi wire cable 40 extends from the fuse 36 down into the water where it is connected to one end of the LED rope 38.

Figure 2:
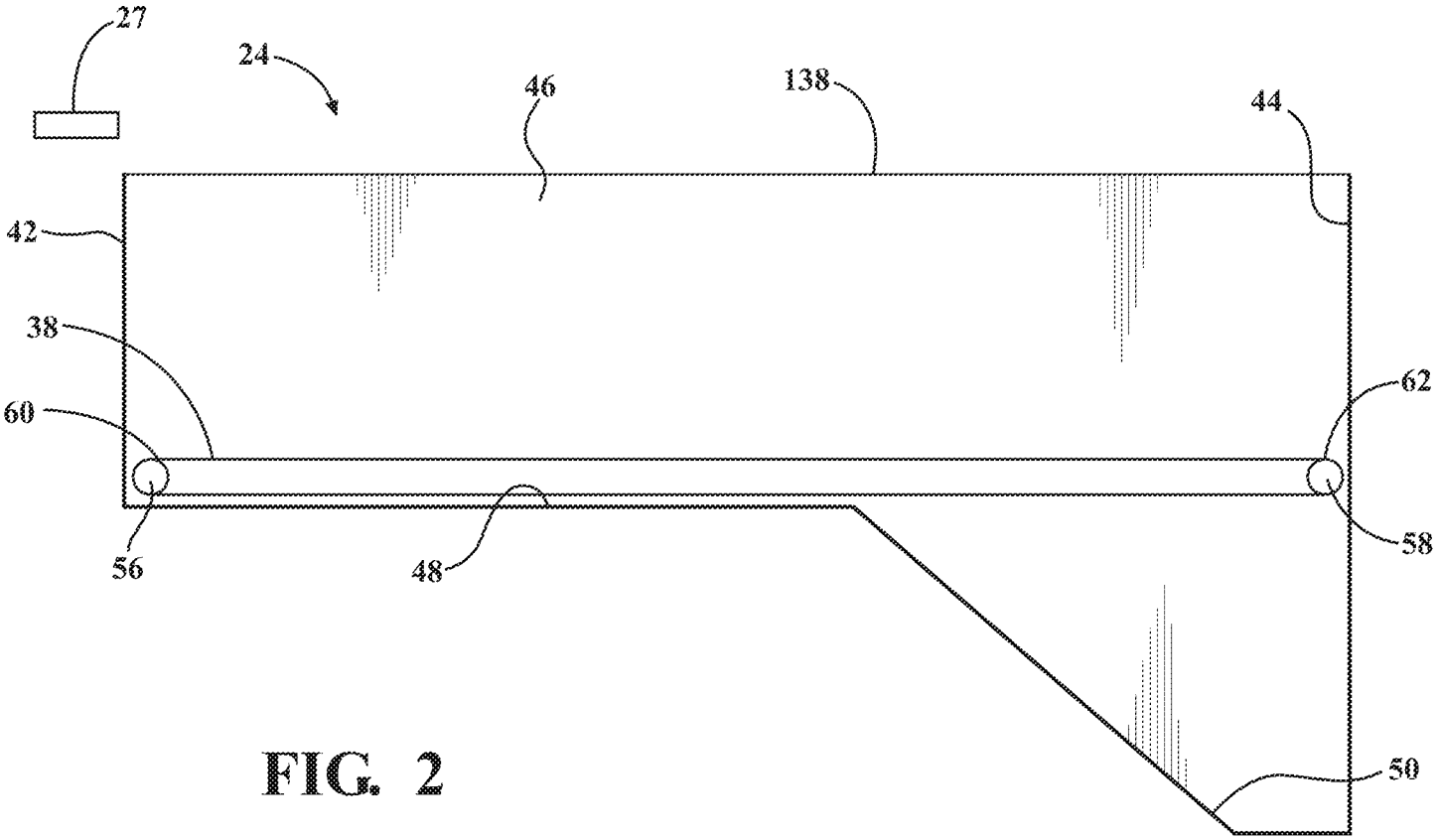
FIG. 2 is a vertical sectional view of a swimming pool with the LED rope extending the entire length at a uniform depth from the water surface.

The LED rope 38 as shown in FIG. 2, is mounted in a swimming pool 24. The swimming pool 24 has a shallow end wall 42, a deep end wall 44, side walls 46 a shallow end floor 48 and a deep end floor 50. The shape of the shallow end floor 48 and the deep end floor 50 vary substantially from one pool to another. The walls 42, 44 and 46 are generally vertical. The floors usually slope some. The shallow end in a competitive racing pool is sufficiently deep for swimmers to dive in from a fixed raised platform 27. A deep end with raised diving platforms may have a water depth that exceeds three meters.

Multiple parallel swimming lanes extend from the shallow end 42 to the deep end 44 of the pool 24. The sides of lanes are marked by cable devices. Outside lanes employ a pool side wall 46 to provide one lane side. The shallow end wall 42 and the deep end wall 44 are twenty five meters apart for many competitive races. Swimmers train in lanes that are twenty-five meters long. They swim the number of laps required to complete the required distance for a specific race or training program. Entry technique and turn around technique are both important.

The LED rope 38 is twenty-five meters long to comply with training practices. First end 60 and second end 62 of the LED rope 38 are anchored to the shallow end wall 42 and the deep end wall 44 by suction cups 56 and 58 or other members. The suction cup 56 on the shallow end wall 42 holds the first end 60 of the LED rope 38 in the water near the depth of the shallow end floor 48. The second suction cup 58 holds a second end 62 of the LED rope 38 in the water at substantially the same depth as the first end 60 of the LED rope.

Figure 3:
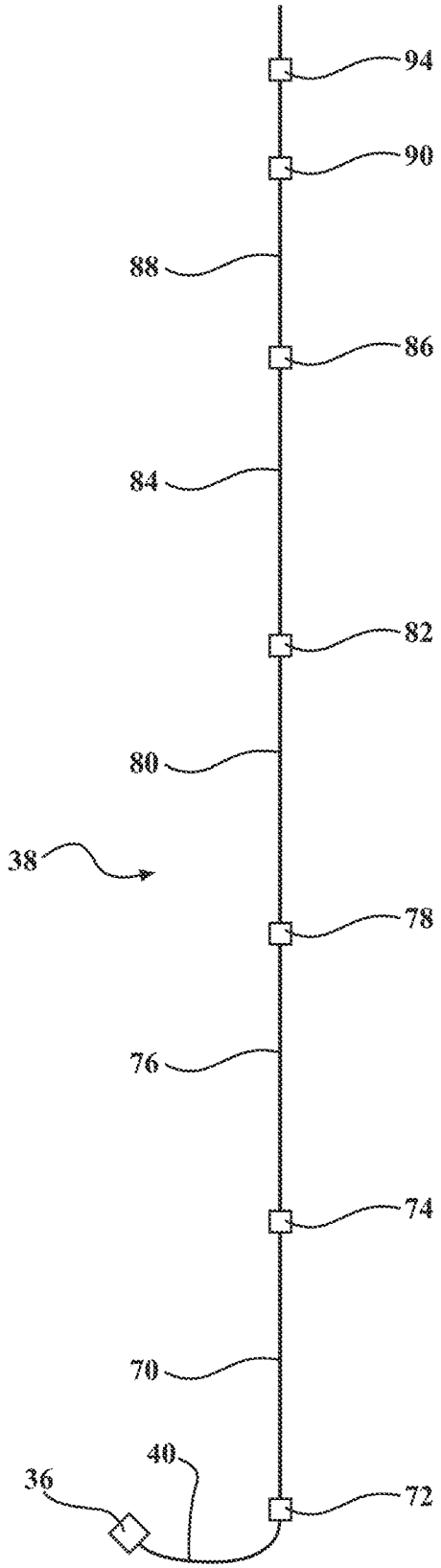
FIG. 3 is a schematic view of the multi section LED rope.

The LED rope 38 is divided into sections as shown in FIG. 3. The first rope section 70 is five meters long and extends from a first coupler 72 to a second coupler 74. The second rope section 76 is five meters long and extends from a second coupler 74 to a third coupler 78. A third rope section 80 is five meters long extends from the third coupler 78 to a fourth coupler 82. A fourth rope section 84 is five meters long and extends from the fourth coupler 82 to a fifth coupler 86. A fifth rope section 88 is three meters long and extends from the fifth coupler 86 to a sixth coupler 90. A sixth rope section 92 is two meters long and extends from the sixth coupler 90 to a seventh coupler 94. The sixth rope section 92 could be two separate one-meter-long rope sections if necessary. With rope sections that are one-meter-long, two meters long and three meters long, a combination of couplers can be obtained to provide a total length of the LED rope 38 that fits a pool with a length that has a different size than a twenty-five-meter competition pool. A standard length pool 24 may replace the fifth rope section 88 and the sixth rope section 92 with a five-meter rope section 84 for example. The five-meter-long rope sections are identical and may be assembled in any order within an LED rope 38. The shorter rope sections may be located in any location within the LED rope 38.

Figure 4:
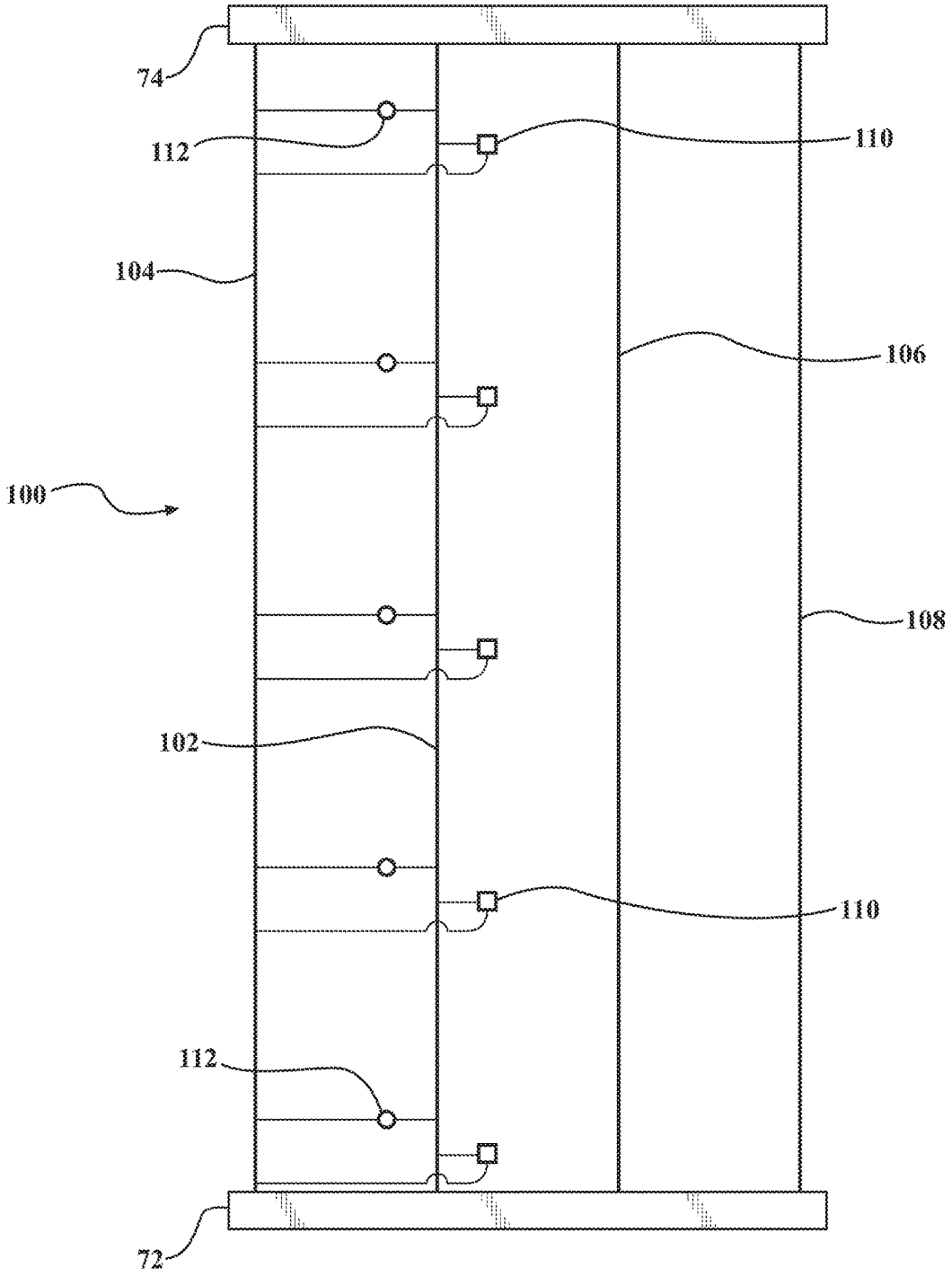
FIG. 4 is a schematic view of one section of the LED rope.
Figure 5:
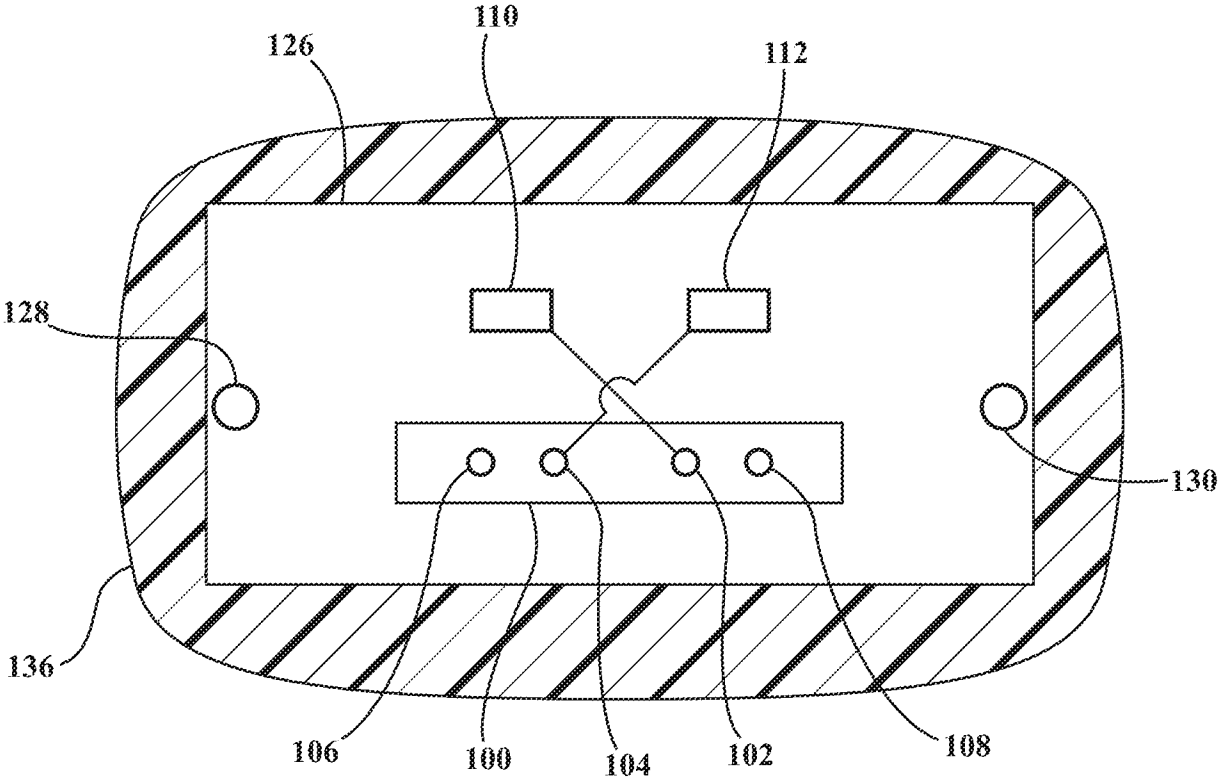
FIG. 5 is an enlarged vertical sectional view of the rope.
Figure 6:
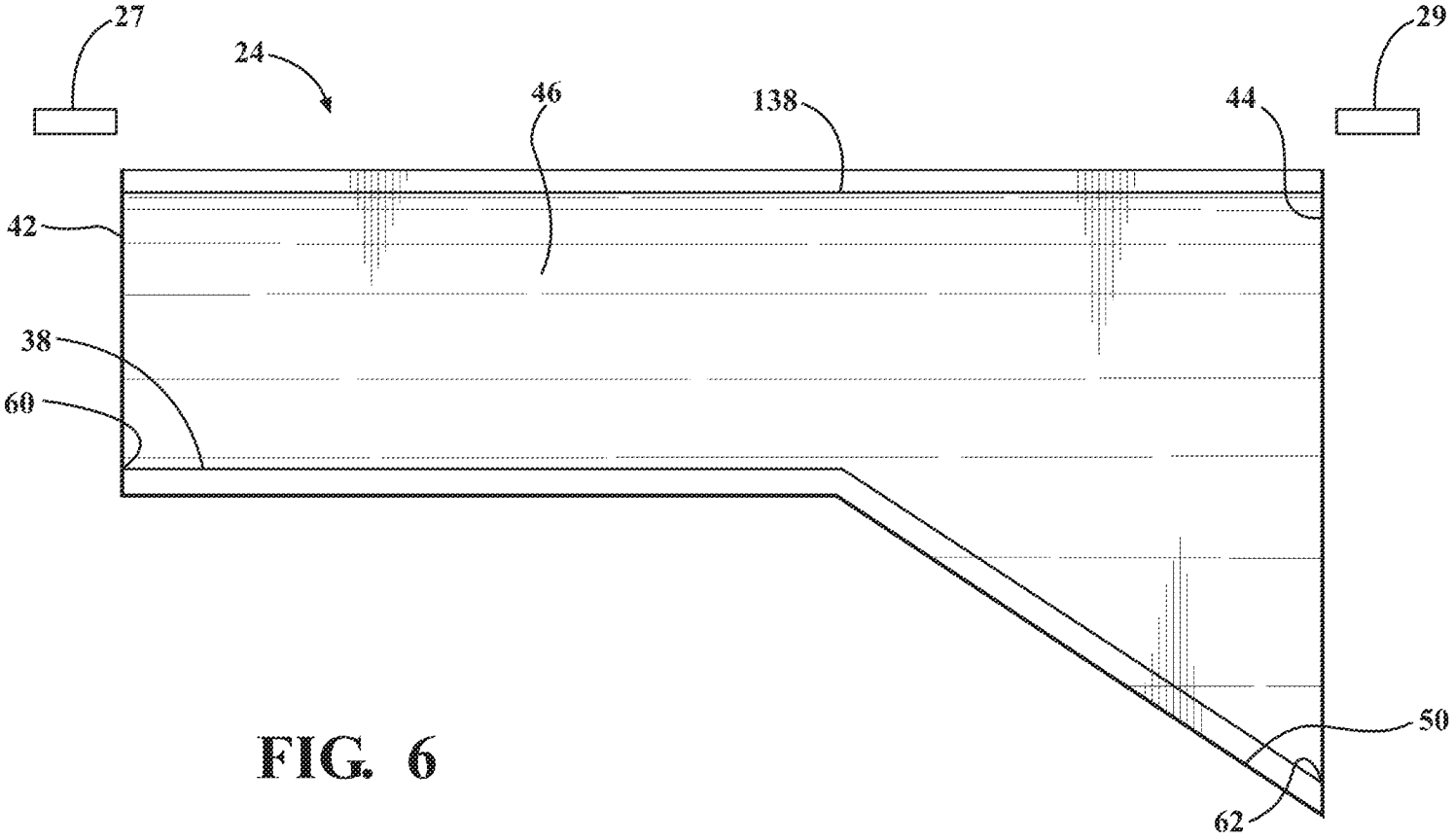
FIG. 6 is a vertical sectional view of a swimming pool with the LED rope on the floor of the pool.

Each rope section of the LED rope 38 has a three or four wire AGB ribbon cable 100, as shown in FIGS. 4 and 5. The ribbon cable 100 has a ground wire 102, a power wire 104, a control wire 106 and a spare wire 108. At least five LEDs 110 are employed in the second rope section 76 between the second coupler 74 and the third coupler 78 for example. These LEDs 110 turn on and off in a series cascade for a swimmer moving from the shallow end wall 42 toward the deep end wall 44. The control wire 106 is programmed to generate a signal that illuminates one LED 110 and turn off another LED 110 simultaneously at a selected pace. One LED 110 may provide a green light at the entry platform 27. The LEDs 110 in all sections of the rope are for a swimmer that enters the pool 24 at the shallow end wall 42, when the swimmer reaches the deep end wall 44 the direction of movement is reversed and the same LEDs 110 provide the pace for returning to the shallow end wall 42. If the swimmer is to swim more than two laps, the direction of the LEDs 110 are reversed again upon reaching the shallow end wall 42. The LEDs 112 in the second rope section 76 between the third coupler 78 and the second coupler 74 as well as all other sections of the LED rope 38 turn on and off in a series cascade for a swimmer that started from the support platform 29 at the deep end wall 44 and toward the shallow end wall 42. The LEDs, 110 are separated from the LEDs, 112 by one and six tenths of an inch.

Upon a swimmer reaching the deep end wall 44 from the shallow end wall 42, the cascade of lights in LED's 110 continues through the LEDs 110 in the opposite direction at the same selected pace. The LEDs 112 set a pace for a swimmer that starts at the deep end wall 44. Upon reaching the shallow end wall 42 from the start of the deep end wall 44, the LEDs 112 reverse direction and continue the pace.

FIG. 5 is a cross sectional view through the LED rope 38. The RGB ribbon cable 100 passes through a small rectangular plastic tube 126 in each rope section 70, 76, 80, 84 88 and 92. The plastic tube 126 is translucent and flexible. Two tension members 128 and 130 also pass through each plastic tube 126. The tension members 128 and 130 prevent the plastic tube 126 from rotating about a long axis of the LED rope 38. Each section of the plastic tube 126 is encased in silicone 136. The silicone 136 is transparent. At an elevated temperature the silicone 136 is a liquid that hardens as it cools. The couplers 72, 74, 78, 82, 86, 90 and 94 are marine grade IP68 connectors. Each of the couplers has two parts that connect together in one position only to hold all of the LEDs 110 and 112 in positions to direct light upward when in use.

The LED rope 38 has a first end 60 that is attached to a suction cup 56 on the shallow end wall 42 of the pool 24. The second end 62 of the LED rope 38 is attached to a suction cup 58 on the deep end wall 44 of the pool 24. The suction cups 56 and 58 hold the LED rope 38 horizontal and a few feet below the surface as stated above. As a result the LEDs are spaced a uniform horizontal distance apart and the pace remains uniform and as selected by the swimmer. The LED rope 38 is tensioned to prevent or limit sinking to the pool floor or floating upward.

The suction cup 56 on the shallow end wall 42 of the pool 24 as shown in FIG. 2 may require the LED rope 38 to be raised a few inches above the shallow end floor 48. In that pool 24, the deep end suction cup 58 will also be raised to maintain the LED rope horizontal. The LED rope 38 will be held above the pool floor 48 and 50 the entire length of the pool 24 that has a deep and a shallow end.

Pool construction may prevent the use of suction cups 56 and 58. Other anchor structure will be required to hold the LED rope 38 in place of the suction cups.

The depth of the LED rope 38 depends upon the age, size and skill of the swimmers. The depth also depends on the pool 24. A depth of the LED rope 38 from the water surface 138 may be less than one meter in some pools 24. The maximum depth of the LED rope 38 should be less than two meters to provide a swimmer reasonably accurate position information.

The LEDs 110 and 112 as described above are one and six tenths of an inch apart. It may be desirable to change the spacing between adjacent LED.

Figure 7:
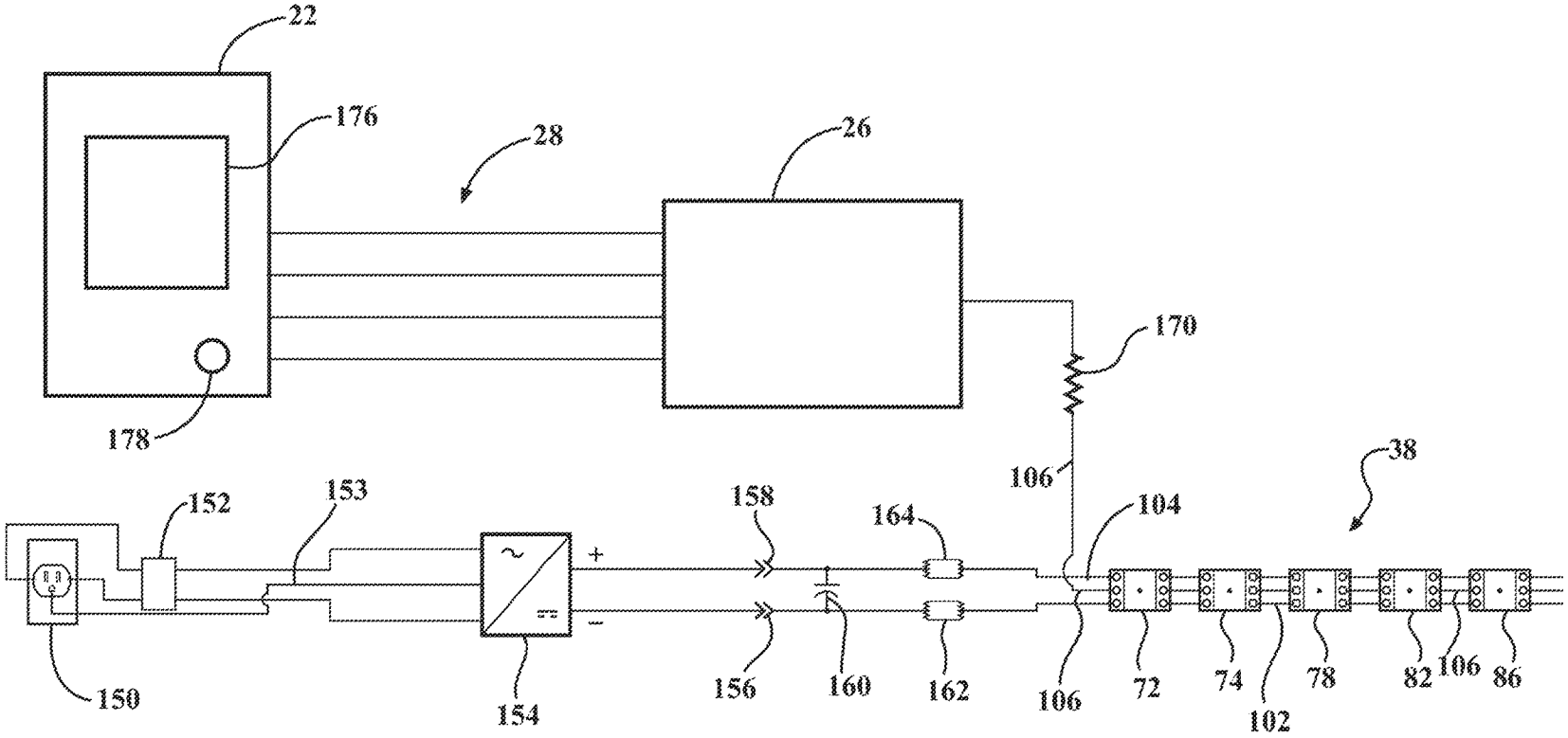
FIG. 7 is a schematic view of the pacing system.

The schematic view of the pacing system shown in FIG. 7 has a 120 volt AC power source 150 with a ground fault interrupt circuit (GFIC) 152. An isolated power supply 154 receives power from the GFIC 152 and the isolated power supply is grounded by a ground wire 153. The isolated power supply 154 has an output of five volts. Two adaptors 156 and 158 supply Direct current from the adapters 156 and 158 through a capacitor 160 and three amp quick react fuses 162 and 164. The fuses 162 and 164 are connected to the ground wire 102 and the power wire 104 of the LED rope 38. The LED rope includes multiple marine grade connectors or couplers 72, 74, 78, 82 and 86 which are shown in FIG. 7. Each connector 72, has a male portion and a female portion that connect four wires together. The couplers mate in one position only, form a water tight connection and lock together. The connectors 72 are capable of holding tension loads encountered by the swimmer pacing apparatus.

A control wire 106 in the LED rope assembly 38 is in communication with a microcontroller 26. A resistor 170 is in the control line 106 between the LED rope 38 and the microcontroller 26. The resistor 170 is positioned close to the microcontroller 26 and out of the water. The resistor has a 300-ohm capacity and functions to prevent voltage spikes in the system. The maximum voltage in the LED rope is five (5) volts.

The LEDS 110 and 112 are LED assemblies. Each assembly includes a microchip. These chips can control the color of the light emitted and the brightness. The LEDs 110 and 112 are able to produce a spectrum of colors including white, green, blue, red, yellow. Brightness could also be changed.

The microcontroller 26 is connected to a display 22. The display 22 includes a touch screen and shield 176. The touchscreen 176 is used to send instructions to the micro controller 26. The touch screen 176 displays the status of training schedules that are underway and make changes during work outs. A start button 178 is provided on the display 22. Start buttons may also be located in other locations.

We claim:

1. A swimmer pacing apparatus comprising:

a LED rope with a first end coupler and a second end coupler;

the LED rope including a ribbon cable with a power wire, a ground wire and a control wire inside a plastic tube, extending from the first end coupler to the second end coupler and encased in a transparent silicone;

a plurality of first LED assemblies each including a microchip and a light emitting diode, spaced from each other a selected distance in the LED rope;

an alternating current source connected to an isolated power supply source and providing a positive DC power source connected to the power wire of the ribbon cable and a ground wire of the isolated power supply source connected to the ground wire of the ribbon cable;

a powered micro controller with a microcontroller output through a resistor to the control wire of the LED rope;

each of the LED assemblies connected to the power wire and the ground wire in the LED rope; and wherein the control wire turns each of the plurality of LEDs on and off in a programmed order and at a selected speed.

2. The swimmer pacing apparatus of claim 1 wherein the LED rope is held below pool water surface during use.

3. The swimmer pacing apparatus of claim 1 including a capacitor between the power wire and the ground wire and located between the isolated power supply source and the first end coupler of the LED rope.

4. The swimmer pacing apparatus of claim 1 including a first fuse in the power wire between the isolated power supply source and the first end coupler and a second fuse in the ground wire between the isolated power supply source and the first end coupler.

5. The swimmer pacing apparatus of claim 1 including intermediate couplers between the first end coupler and the second end coupler of the LED rope.

6. The swimmer pacing apparatus of claim 1 wherein the spacing between two of the plurality of first LED assemblies is a horizontal distance.

7. A swimmer pacing apparatus comprising:

a LED rope with a first end coupler and a second end coupler;

the LED rope including a ribbon cable with a power wire, a ground wire and a control wire inside a plastic tube, extending from the first end coupler to the second end coupler and encased in a transparent silicone;

a plurality of first LED assemblies each including a microchip and a light emitting diode, spaced from each other a selected distance in the LED rope;

an alternating current source connected to an isolated power supply source and providing a positive DC power source connected to the power wire of the ribbon cable and a ground wire of the isolated power supply source connected to the ground wire of the ribbon cable;

a powered micro controller with a microcontroller output through a resistor to the control wire of the LED rope;

each of the first LED assemblies connected to the power wire and the ground wire in the LED rope;

wherein the control wire turns each of the plurality of first light emitting diodes on and off in a programmed order and at a selected speed, a microchip and a light emitting diode with the LED assemblies spaced from each other a selected distance in the LED rope;

each of the plurality of second LED assemblies connected to the power wire and to the ground wire in the LED rope; and wherein the control wire turns each of the plurality of second light emitting diodes on and off in a programmed order and at a selected speed.

8. The swimmer pacing apparatus of claim 7 wherein a first packing light assembly illuminated in the LED rope in the plurality of first LED assemblies is adjacent to the first end coupler and the first pacing light assembly illuminated in the LED rope in the plurality of second LED assemblies is adjacent to the second end coupler.

9. The swimmer pacing apparatus of claim 7 including a capacitor between the power wire and the ground wire and located between the isolated power supply source and the first end coupler of the LED rope.

10. The swimmer pacing apparatus of claim 7 including intermediate couplers between the first end coupler and the second coupler of the LED rope.

* * * * *